United States Patent [19]

Peterson et al.

[11] Patent Number: 4,874,537

[45] Date of Patent: Oct. 17, 1989

[54] STABLE LIQUID NONAQUEOUS DETERGENT COMPOSITIONS

[75] Inventors: David Peterson; Loren Chen, both of Pleasanton; Robert J. Iliff, Oakley, all of Calif.

[73] Assignee: The Clorox Company, Oakland, Calif.

[21] Appl. No.: 251,719

[22] Filed: Sep. 28, 1988

[51] Int. Cl.[4] ..... C11D 3/075; C11D 3/39

[52] U.S. Cl. ..... 252/99; 252/95; 252/135; 252/174.12; 252/174.21; 252/174.22; 252/540; 252/559; 252/DIG. 14

[58] Field of Search ..... 252/95, 99, 135, 174.12, 252/174.21, 174.22, 539, 540, 558, 559, DIG. 14

[56] References Cited

U.S. PATENT DOCUMENTS

| | | | |
|---|---|---|---|
| 3,169,930 | 2/1965 | Gedge | 252/137 |
| 3,625,909 | 12/1971 | Berg et al. | 252/153 |
| 3,630,929 | 12/1971 | van Dijk | 252/136 |
| 3,640,885 | 2/1972 | Rhees | 252/186 |
| 3,661,786 | 5/1972 | Desforges | 252/99 |
| 3,723,327 | 3/1973 | van Kampen et al. | 252/110 |
| 3,784,476 | 1/1974 | van Kampen et al. | 252/109 |
| 3,789,001 | 1/1974 | Painelli | 252/99 |
| 3,798,181 | 3/1974 | Vazquez | 252/539 |
| 3,950,277 | 4/1976 | Stewart et al. | 252/541 |
| 4,001,132 | 1/1977 | Maguire | 252/105 |
| 4,014,806 | 3/1977 | Connor et al. | 252/110 |
| 4,081,395 | 3/1978 | Talley | 252/106 |
| 4,101,457 | 7/1978 | Place et al. | 252/559 |
| 4,107,067 | 8/1978 | Murphy et al. | 252/135 |
| 4,123,395 | 10/1978 | Maguire et al. | 252/559 |
| 4,162,987 | 7/1979 | Maguire et al. | 252/135 |
| 4,201,686 | 5/1980 | Augustijn | 252/174.22 |
| 4,234,444 | 11/1980 | Wegener et al. | 252/174.22 |
| 4,264,466 | 4/1981 | Carleton et al. | 252/158 |
| 4,272,394 | 6/1981 | Kaneko | 252/99 |
| 4,294,717 | 10/1981 | Couderc et al. | 252/97 |
| 4,316,812 | 2/1982 | Hancock et al. | 252/99 |
| 4,326,976 | 4/1982 | Logan et al. | 252/99 |
| 4,326,979 | 4/1982 | Bus et al. | 252/15 |
| 4,340,766 | 7/1982 | Klahr et al. | 568/625 |
| 4,349,448 | 9/1982 | Steele | 252/135 |
| 4,409,136 | 10/1983 | Cheng | 252/540 |
| 4,438,014 | 3/1984 | Scott | 252/174.21 |
| 4,648,987 | 3/1987 | Smith et al. | 252/559 |
| 4,650,599 | 3/1987 | Farnworth | 252/99 |
| 4,661,452 | 4/1987 | Markussen et al. | 435/187 |
| 4,707,291 | 11/1987 | Thom et al. | 252/174.12 |
| 4,743,394 | 5/1988 | Kaufmann et al. | 252/90 |
| 4,753,750 | 6/1988 | Ouhadi et al. | 252/139 |
| 4,772,412 | 9/1988 | Green et al. . | |

FOREIGN PATENT DOCUMENTS

| | | |
|---|---|---|
| 158464 | 10/1985 | European Pat. Off. . |
| 177183 | 4/1986 | European Pat. Off. . |
| 225654 | 6/1987 | European Pat. Off. . |
| 234867 | 9/1987 | European Pat. Off. . |
| 2173224 | 10/1986 | United Kingdom . |
| 2194536 | 3/1988 | United Kingdom . |
| 2195125 | 3/1988 | United Kingdom . |
| 2195649 | 4/1988 | United Kingdom . |
| 2196347 | 4/1988 | United Kingdom . |
| 2196981 | 5/1988 | United Kingdom . |
| 2200366 | 8/1988 | United Kingdom . |

*Primary Examiner*—Prince E. Willis

*Attorney, Agent, or Firm*—Joel J. Hayashida; Michael J. Mazza; Stephen M. Westbrook

[57] ABSTRACT

The present invention provides a stable liquid, substantially nonaqueous, detergent comprising, by weight percent:

(a) 20–90% of a liquid portion which comprises an alkoxylated nonionic surfactant;

(b) a solids portion which comprises:

(i) 5–50% of a builder;

(ii) 0–20% of an oxidant; said solids being stably suspended in said liquid portion, by means of (c) a phase stabilizing amount of a lower alkylated fused ring polyarylene sulfonate; and (d) 0–5% of a hydrolytic enzyme.

Further desirable adjuncts may be added to the liquid compositions of this invention.

15 Claims, No Drawings

STABLE LIQUID NONAQUEOUS DETERGENT COMPOSITIONS

BACKGROUND OF THE INVENTION

1. Field of the Invention

This invention relates to phase stable, liquid nonaqueous detergents, which contain enzymes and oxidants, and have prolonged physical stability, even at elevated temperatures for extended periods of time.

2. Brief Description of the Prior Art

There are many instances of liquid, nonaqueous detergent formulations in the prior art. Maguire et al., U.S. Pat. No. 4,123,395, discloses an automatic dishwater detergent composition comprising a low-foaming nonionic surfactant and a sulfonated aromatic compatibilizing agent having a CMC greater than 1% by weight at 25° C., in which the nonionic:sulfonated compatibilizing agent ratio is 2:5 to about 5:3, and the composition is a paste, a gel or a nonaqueous liquid. The compositions of Maguire would be inappropriate for use as a laundry detergent. Automatic dishwaters generally wash dishes at much higher temperatures than washing machines launder clothing, and the type of foaming surfactants utilized in laundry detergents would be inappropriate for use in ADWD's. Further, Maguire does not teach, disclose or suggest the need to provide phase stable, substantially nonaqueous liquid detergents.

van Dijk, U.S. Pat. No. 3,630,929, discloses a substantially nonaqueous liquid detergent consisting essentially of nonionic surfactant, detergent builder, an inorganic carrier, and an acid solubilizer. This reference discloses the need to use an inorganic carrier to prevent phase separation. However, the use of such inorganic materials apparently has deleterious effects on solubility of the composition, since an acid solubilizer, such as acetic acid must also be present.

Carleton et al., U.S. Pat. No. 4,264,466, discloses a liquid detergent mull comprising a dispersed solid in a liquid nonionic surfactant, which is stabilized by a chain structure clay. This particular formulation suggests that a "chain structure type" clay must be present as a suspending material. Applicants however, have found that chain structure type clays adversely affect solubility of liquid detergent formulations. Moreover, chain structure clays have also been found to cause deleterious results in solubility and pourability upon storage, and also upon the addition of extraneous water, in substantially nonaqueous liquid detergents.

Hancock et al., U.S. Pat. No. 4,316,812, discloses a liquid, nonaqueous detergent comprising a dispersion of solids in a liquid nonionic surfactant having a pour point of less than 10° C., in which the solids comprise builders and an oxygen bleach, and there is allegedly no dispersant for the solids. However, Hancock apparently does require a dispersant which is either a finely divided silica (Aerosil), a polyethylene glycol, or both (Cf. Examples 1, 2 and 5 of Hancock).

However, the art does not disclose, teach or suggest that lower alkylated, sulfonated, fused ring arylenes can dramatically and unexpectedly improve physical stability of liquid, nonaqueous detergents. Moreover, none of the art discloses, teaches or suggests that a phase stabilizer which is a lower alkylated, sulfonated, fused ring arylene has dramatic and unexpected physical stabilizing properties in substantially nonaqueous liquid detergents.

SUMMARY OF THE INVENTION AND OBJECTS

The invention comprises, in one embodiment, a stable, liquid, substantially nonaqueous detergent comprising, by weight percent:

(a) 20–90% of a liquid portion which comprises an alkoxylated nonionic surfactant;

(b) 5–50% of a solids portion which comprises:

(i) a builder;

(ii) 0–20% of the detergent of an oxidant; said solids being stably suspended in said liquid portion, by means of (c) a phase stabilizing amount of a lower alkylated fused ring polyarylene sulfonate; and (d) 0–5% of a hydrolytic enzyme.

In another embodiment of this invention, the invention comprises a phase stable, substantially nonaqueous liquid detergent comprising:

(a) at least 20% of a liquid portion comprising at least one nonionic surfactant having a pour point of less than 40° C. and an HLB of between 2 and 16;

(b) a solids portions comprising (i) at least about 5% of an alkaline builder and (ii) at least about 1% of an oxidant, the solids portion having an average particle size of between 1 to 50 microns; the solids being stably suspended in the liquid portion by:

(c) a stabilizing-effective amount of $C_{1-4}$ dialkylated naphthalene sulfonate;

It is therefore an object of this invention to provide a phase stable liquid, substantially nonaqueous detergent.

It is a further object of this invention to provide a liquid, substantially nonaqueous detergent which has prolonged physical stability despite extended storage and elevated temperatures.

It is another object of this invention to provide a substantially nonaqueous liquid detergent in which a solid, oxidant, a builder, and an enzyme can be present for soil and stain removal.

It is yet another object of this invention to provide a stable, nonaqueous liquid detergent which remains pourable despite the addition of amounts of water up to about 20% by weight by the liquid detergent.

It is a still further object of this invention to provide a liquid, substantially nonaqueous detergent which is easily pourable at room temperature.

It is also an object of this invention to avoid inorganic stabilizers, such as clays, or silicas, which have proven to have undesirable disadvantages when the liquid detergents which contain them are subjected to high storage temperatures.

DETAILED DESCRIPTION OF THE PREFERRED EMBODIMENTS

As mentioned above, the present invention provides a stable, liquid nonaqueous detergent, in which the solids portion is stably dispersed throughout the liquid portion and maintained in dispersion by the use of a stabilizer comprising a lower alkylated fused ring polyarylene sulfonate. Further standard detergent adjuncts, especially enzymes, can be present in these compositions.

Liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product.

In the present invention, a liquids portion, comprising substantially nonionic surfactants, suspends a solids portion which substantially comprises builders and oxidants, as well as other solid adjuncts. However, in order to maintain fluidity, the nonionic surfactant is present in a substantial excess to the solids portion. The problem presented by the liquid, nonionic surfactant predominating is that the liquids and solids portion will have a tendency to undergo phase separation. This will result in visible, discrete layers in the liquid, the solids portion settling to the bottom of the liquid.

The two component stabilizing system of the present invention has overcome this problem. In the following description, the components of the invention are described.

1. Liquids Portion

The liquid portion comprises substantially only liquid, nonionic surfactant, although amounts of some other liquids, such as solvents, liquid hydrotropes, and the like may also be present. The nonionic surfactant present in the invention will preferably have a pour point of less than about 40° C., more preferably less than 30° C., and most preferably below 25° C. They will have an HLB (hydrophile-lipophile balance) of between 2 and 16, more preferably between 4 and 14, and most preferably between 9 and 12. However, mixtures of lower HLB surfactants with higher HLB surfactants can be present as the liquid portion of the detergent, the resulting HLB usually being an average of the two or more surfactants. Additionally, the pour points of the mixtures can be, but are not necessarily, weighted averages of the surfactants used.

The nonionic surfactants are preferably selected from the group consisting of $C_{6-18}$ alcohols with 1–15 moles of ethylene oxide per mole of alcohol, $C_{6-18}$ alcohols with 1–10 moles of propylene oxide per mole of alcohol, $C_{6-18}$ alcohols with 1–15 moles of ethylene oxide and 1–10 moles of propylene oxide per mole of alcohol, $C_{6-18}$ alkylphenols, with 1–15 moles of ethylene oxide or propylene oxide or both, and mixtures of any of the foregoing. Certain suitable surfactants are available from Shell Chemical Company under the trademark Neodol. Suitable surfactants include Neodol 23-6.5 ($C_{12-13}$ alcohol with an average 6.5 moles of ethylene oxide per mole of alcohol), Neodol 25-9 ($C_{12-15}$ alcohol with an average 9 moles of ethylene oxide per mole of alcohol) and Neodol 25-3 ($C_{12-15}$ alcohol). These and other nonionic surfactants used in the invention can be either linear or branched, or primary or secondary alcohols. If these surfactants are partially unsaturated, they can vary from $C_{10-22}$ alkoxylated alcohols, with a minimum iodine value of at least 40, such as exemplified by Drozd et al., U.S. Pat. No. 4,668,423, which is incorporated herein by reference. If the surfactants are partially propoxylated, they can vary from propoxylated $C_{8-24}$ alcohols. An example of an ethoxylated propoxylated alcohol is Surfonic JL-80X ($C_{9-11}$ alcohol with about 9 moles of ethylene oxide and 1.5 moles of propylene oxide per mole of alcohol).

Other suitable nonionic surfactants may include polyoxyethylene carboxylic acid esters, fatty acid glycerol esters, fatty acid and ethoxylated fatty acid alkanolamides, certain block copolymers of propylene oxide and ethylene oxide and block polymers of propylene oxide and ethylene oxide with propoxylated ethylene diamine (or some other suitable initiator). Still further, such semi-polar nonionic surfactants as amine oxides, phosphine oxides, sulfoxides and their ethoxylated derivatives, may be suitable for use herein.

Nonionic surfactants are especially preferred for use in this invention since they are generally found in liquid form, usually contain 100% active content, possess little water, and are particularly effective at removing oily soils, such as sebum and glycerides.

2. Solids Portion

The solids portion of the invention, as previously mentioned, substantially comprises alkaline builders, inorganic oxidants, and other adjuncts which are granular or particulate in nature, such as enzymes and pigments. However, the present discussion is limited to builders and oxidants.

The builders are typically alkaline builders, i.e., those which in aqueous solution will attain a pH of 7–14, preferably 9–12. Examples of inorganic builders include the alkali metal and ammonium carbonates (including sesquicarbonates and bicarbonates), silicates (including polysilicates and metasilicates), phosphates (including orthophosphates, tripolyphosphates and tetrapyrophosphates), aluminosilicates (both natural and synthetic zeolites), and mixtures thereof. Carbonates are especially desirable for use in this invention because of their high alkalinity and effectiveness in sequestering heavy metals which may be present in hard water, as well as their low cost.

Organic builders are also suitable for use, and are selected from the group consisting of the alkali metal and ammonium sulfosuccinates, polyacrylates, polymaleates, copolymers of acrylic acid and maleic acid or maleic anhydride, nitrilotriacetic acid, ethylenediaminetetraacetic acid, citrates and mixtures thereof.

The oxidant, when an inorganic peroxide, generally comprises materials which, in aqueous solution, provide hydrogen peroxide. These include, preferably, the alkali metal percarbonates, perborates (both perborate monohydrate and perborate tetrahydrate), and hydrogen peroxide adducts. Other peroxygen sources may be possible, such as monopersulfates and monoperphosphates. In may also be possible to use organic oxidants, e.g., organic peroxides and organic peracids. Examples of applicable peracids may include hydrotropic peracids (e.gs., Johnston, U.S. Pat. No. 4,100,095, and Coyne et al., U.S. patent application Ser. No. 06/899,461, filed Aug. 22, 1986, both of which are incorporated herein by reference) and surface active or hydrophobic peracids (e.gs., Hsieh et al., U.S. Pat. Nos. 4,655,789, and Bossu, 4,391,725, both of which are incorporated herein by reference). In the present invention, it is especially preferred to use sodium perborate monohydrate. This particular oxidant provides, on a weight basis, more hydrogen peroxide than another suitable material, sodium perborate tetrahydrate, since sodium perborate monohydrate contains only one mole of waters of hydration.

It is preferred that the invention comprise about 20–90% of the liquid portion, and 5–50% of the solids portion stably suspended therein, said 5–50% of solids comprising substantially all builder, while 0–20% of an oxidant is simultaneously present. More preferably, 20–30% of the builder is present, along with 1–15% oxidant, most preferably 22–28% builder, along with 5–10% oxidant. However, the ratio of liquids portion to solids portion will generally range from about 3:1 to 1:1, more preferably at least 2:1 to 1:1.

The solids portion should generally have a particle size between 1–50 microns, more preferably between 1–30 microns, and most preferably between 1–25 microns, average particle size. Although many suppliers of these solids can provide a range of particle size, the desired particle size can also be obtained by using ball mills or grinders.

3. Stabilizer

The stabilizer is a lower alkylated fused ring polyarylene sulfonate.

The lower alkylated fused ring polyarylene sulfonates are also referred to as sulfonated, alkylated condensed ring aryl compounds. Aromatic radicals comprising the fused ring system can include naphthalene, anthracene and phenanthrene. Especially preferred herein are lower alkylated naphthalene sulfonates. "Lower alkylated" generally refers to $C_{1-4}$ alkyls. These alkyls can be straight chain, or branched. Especially preferred alkylated naphthalene sulfonates are the alkali metal cation salts (potassium, sodium or lithium) thereof.

Especially preferred for use herein is diisopropylnaphthalene sulfonate. One such example is Nekal BA-77 (75% active), sold by GAF Chemicals.

The present stabilizing system has demonstrated unusually dramatic and unexpected improvement in physical stability in these liquid detergents. While it is presently unknown exactly why this is so, Applicants speculate, without being bound by theory, that the anionic nature of the stabilizer may be responsible for the improved dispersion of the solids in the liquids portion. Additionally, again, without being bound to theory, the stabilizing system apparently improves stability by preventing particle settling. Also, the use of this stabilizing system apparently provides desirable rheological properties, such as higher yield value, without an undesirably large increase in viscosity. This liquid detergent is a thixotropic liquid, which flows upon adequate shearing. The present invention has a preferable viscosity of about 1–5,000 centipoises (CPS), more preferably 5–2,000 CPS, and most preferably 10–1,500 CPS. The amount of phase stabilizer is about 1–20%, more preferably 1–10%, and most preferably, 3–10%.

Furthermore, this detergent does not gel up, or cease being flowable, even if added amounts of water to about 20% are present. This was especially surprising since water addition to nonaqueous nonionic liquid detergents tends to cause gelling or stiffening of the liquid matrix, as a result of a complex network forming in the detergent. This may be an interaction between the solids (especially inorganic alkaline builders), the surfactants, and the water, although this theory is not binding on Applicants and mainly offered as a possible explanation. A gel is thus considered here a nonpourable liquid. Water is a potential problem in these sorts of detergents since extraneous water from sources such as condensation in an area where the detergent container is stored (especially where there are temperature fluctuations), or high humidity, or where the user deliberately or accidentally adds water to the container, e.g., while rinsing the container closure or the bottle. This latter category is especially prevalent when the closure is used as a measuring device, and the user rinses the closure before recombining it with the container.

In another embodiment of this invention, it is preferred to add 0–40% of an additional phase stabilizer in combination with the inventive lower alkylated fused ring polyarylene stabilizer. These stabilizers are generally selected from anionic sulfates and sulfonates. Nonlimiting examples are $C_{6-18}$ alkyl aryl sulfonates; $C_{6-18}$ alkyl ether sulfates (which contain 1–10 moles of ethylene oxide per mole of alcohol, exemplary of which is Neodol 25-3S, Shell Chemical Company; $C_{8-18}$ alkyl sulfosuccinates, e.g., Aerosol OT, American Cyanamid; $C_{8-18}$ alkyl sulfates; secondary alkane (paraffin) sulfonates, e.g., Hostapur SAS, Farbwerke Hoechst A.G.; alpha-olefin sulfonates; and alkylated diphenyl oxide disulfonates, e.g., Dowfax surfactants, Dow Chemical Company. This additional stabilizer is preferably a $C_{6-18}$ alkyl aryl sulfonate.

The $C_{6-18}$ alkyl aryl sulfonates are typically considered anionic surfactants. Especially preferred are $C_{9-18}$ alkyl benzene sulfonates, and most especially preferred are $C_{10-14}$ alkyl benzene sulfonates. An example thereof is Calsoft F-90 (90% active, solid) sodium alkyl benzene sulfonate, available from Pilot Chemical Company. The acidic form of these surfactants, HLAS, may also be appropriate. For example, Biosoft S-130, available from Stepan Chemical Company, may also be suitable for use herein. See also the description of acidic surfactants in Choy et al., U.S. Pat. No. 4,759,867, incorporated herein by reference.

When the combination of phase stabilizers is used, it is preferred that the two constituents of the thus formed stabilizing system be in a ratio of about 10:1 to about 1:10, more preferably 4:1 to 1:4, and most preferably 3:1 to 1:3.

4. Hydrolytic Enzymes

Enzymes are especially desirable adjunct materials in these liquid detergents. Unlike aqueous detergents, these substantially nonaqueous detergents may be able to maintain the chemical stability, that is, the activity, of these enzymes markedly better, since water is substantially not present to mediate enzyme decomposition, denaturation or the like.

Proteases are one especially preferred class of enzymes. They are selected from acidic, neutral and alkaline proteases. The terms "acidic", "neutral," and "alkaline," refer to the pH at which the enzymes' activity are optimal. Examples of neutral proteases include Milezyme (available from Miles Laboratory) and trypsin, a naturally occurring protease. Alkaline proteases are available from a wide variety of sources, and are typically produced from various microorganisms (e.g., Bacillis subtilisin). Typical examples of alkaline proteases include Maxatase and Maxacal from International BioSynthetics, Alcalase, Savinase and Esperase, all available from Novo Industri A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase, from Societe Rapidase, Milezyme from Miles Laboratory, and Maxamyl from International BioSynthetics.

Still other suitable enzymes are cellulases, such as those described in Tai, U.S. Pat. Nos. 4,479,881, Murata et al., 4,443,355, Barbesgaard et al., 4,435,307, and Ohya et al., 3,983,082, incorporated herein by reference.

Yet other suitable enzymes are lipases, such as those described in Silver, U.S. Pat. Nos. 3,950,277, and Thom et al., 4,707,291, incorporated herein by reference.

The hydrolytic enzyme should be present in an amount of about 0–5%, more preferably 0.01–3%, and most preferably 0.1–2% by weight of the detergent. Mixtures of any of the foregoing hydrolases are desirable, especially protease/amylase blends.

5. Adjuncts

The standard detergent adjuncts can be included in the present invention. These include dyes, such as Monastral blue and anthraquinone dyes (such as those described in Zielske, U.S. Pat. Nos. 4,661,293, and 4,746,461). Pigments, which are also suitable colorants, can be selected, without limitation, from titanium dioxide, ultramarine blue (see also, Chang et al., U.S. Pat. No. 4,708,816), and colored aluminosilicates. Fluorescent whitening agents are still other desirable adjuncts. These include the stilbene, styrene, adn naphthalene derivatives, which upon being impinged by visible light, emit or fluoresce light at a different wavelength. These FWA's or brighteners are useful for improving the appearance of fabrics which have become dingy through repeated soilings and washings. A preferred FWA is Tinopal CBS-X, from Ciba Geigy A.G. Examples of suitable FWA's can be found in U.S. Pat. Nos. 1,298,577, 2,076,011, 2,026,054, 2,026,566, 1,393,042; and U.S. Pat. No. 3,951,960, 4,298,290, 3,993,659, 3,980,713 and 3,627,758, incorporated herein by reference. Anti-redeposition agents, such as carboxymethylcellulose, are potentially desirable. Next, foam boosters, such as appropriate anionic surfactants, may be appropriate for inclusion herein. Also, in the case of excess foaming resulting from the use of certain nonionic surfactants, anti-foaming agents, such as alkylated polysiloxanes, e.g., dimethylpolysiloxane would be desirable. Also, certain solvents, such as glycol, e.gs., propylene glycol, and ethylene glycol, certain alcohols, such as ethanol or propanol, and hydrocarbons, such as paraffin oils, e.g., Isopar K from Exxon U.S.A., may be useful to thin these liquid compositions. Buffers may also be suitable for use, such as sodium hydroxide, sodium borate, sodium bicarbonate, to maintain a more alkaline pH in aqueous solution, and acids, such as hydrochloric acid, sulfuric acid, citric acid and boric acid, would be suitable for maintaining or adjusting to a more acidic pH. Next, bleach activators could well be very desirable for inclusion herein. This is because the present invention is substantially nonaqueous, and thus, the bleach activators, which are typically esters, may maintain their stability better than in other liquids since they would be less likely to be hydrolyzed in the substantially nonaqueous liquid composition. Suitable examples of appropriate bleach activators may be found in Mitchell et al., U.S. Pat. No. 4,772,290, Fong et al., published Eureopean Patent Application EP No. 185,522, Fong et al., published European Patent Application EP No. 267,047, Zielske et al., published European Patent Application EP No. 267,048, Zielske, published European Patent Application EP No. 267,046, Zielske, U.S. Pat. Nos. 4,735,740, Chung et al., 4,412,934, Hardy et al., 4,681,952, Wevers et al., 4,087,367, and Hampson et al., U.K. No. 864,798, all of which are incorporated herein by reference. Lastly, in case the composition is too thin, some thickeners such as gums (xanthan gum and guar gum) and various resins (e.g., polyvinyl alcohol, and polyvinyl pyrrolidone) may be suitable for use. Fragrances are also desirable adjuncts in these compositions.

The additives may be present in amounts ranging from 0–50%, more preferably 0–40%, and most preferably 0–20%. In certain cases, some of the individual adjuncts may overlap in other categories. For example, some buffers, such as silicates may be also builders. Also, some surface active esters may actually function to a limited extent as surfactants. However, the present invention contemplates each of the adjuncts as providing discrete performance benefits in their various categories.

EXPERIMENTAL

In Table I below, two compositions, which are meant to represent prior art, are compared against the inventive composition. The stabilities of these three compositions at elevated temperatures and for extended times is compared in Table II.

TABLE I

| Ingredient | Comparative Formulations A | Comparative Formulations B | Invention C |
|---|---|---|---|
| Nonionic Surfactant | 64.17[1] | 63.70[2] | 61.34[1] |
| Sodium Carbonate | 25.27 | 25.27 | 25.00 |
| Sodium Perborate Monohydrate | 6.06 | 6.06 | 6.00 |
| Calsoft F-90[3] | 3.39 | 3.39 | 3.34 |
| Nekal BA-77[4] | 0.00 | 0.00 | 3.23 |
| Clay | 0.00 | 0.50 | 0.00 |
| Fluorescent Whitening Agent | 0.54 | 0.54 | 0.53 |
| Enzyme | 0.57 | 0.57 | 0.58 |

[1]Neodol 23-6.5, Shell Oil Company.
[2]A mixture of 9 parts developmental surfactant (nonionic) to one part Neodol 23-6.5, Shell Oil Company.
[3]Sodium salt of linear $C_{11}$ alkyl benzene sulfonate, Pilot Chemical Company (90% active).
[4]Diisopropylnaphthalene sulfonate from GAF Chemicals.

TABLE II

| | Stability to Settling (Percent Separation)[1] | | | | | |
|---|---|---|---|---|---|---|
| | A | B | C | | | |
| | 1 week | 1 week | 1 week | 2 week | 3 week | 4 week |
| 21° C. | 50% | 30% | 0% | 0% | 0% | 0% |
| 38° C. | 50% | 40% | 2% | 2% | 2% | 3% |
| 49° C. | 60% | 40% | 4% | 7% | 10% | 13% |

[1]Physical stability measured as % separation,

Table II, above, demonstrates dramatic and unexpected superiority of the invention compositions over the prior art. Example A, which uses only an anionic surfactant, $C_{11.4}$ alkyl benzene sulfonate, has fairly poor stability at elevated temperatures. The second prior art composition,, which is based on an inorganic stabilizer, clay, also has fairly poor stability over an extended period of time. However, the inventive compositions show dramatic and surprising stabilities even at elevated temperatures as high as 120° F. (49° C.), and for as long as four weeks.

In Tables III and IV, the stability of the fused ring arylene sulfonate stabilizer is compared against other hydrotropic materials. The invention's stabilizer shows dramatically effective and surprising stability performance against other types of hydrotropes.

TABLE III

| Ingredient & wt. % | Base Formulation | D | E | F | G |
|---|---|---|---|---|---|
| Neodol 91-6 Surfactant[1] | 65.00 | | | | |
| $Na_2CO_3$[2] | 24.95 | | | | |
| Sodium Perborate Monohydrate[3] | 6.11 | | | | |

TABLE III-continued

| Ingredient & wt. % | Base Formulation | | | |
|---|---|---|---|---|
| | D | E | F | G |
| Calsoft F-90 Surfactant[4] | 3.40 | | | |
| Tinopal 5BM[5] | 0.54 | | | |
| Inventive Fused Ring Sulfonate[6] | 0.50 | | | |
| Lignosulfonate[7] | | 0.50 | | |
| Sodium Xylene Sulfonate[8] | | | 0.50 | |
| Condensation Product of Naphthalenesulfonate/Formaldehyde[9] | | | | 0.50 |

[1]$C_{9-11}$ alcohol condensed with about 6 moles of ethylene oxide per mole, Shell Oil Company.
[2]Builder.
[3]Oxidant.
[4]Sodium salt of linear $C_{11}$ alkyl benzene sulfonate; Pilot Chemical Company (90% active).
[5]Fluorescent whitening agent, Ciba Geigy A.G.
[6]Nekal-BA 77, diisopropylnaphthalene sulfonate.
[7]Marasperse CBOS-3, a sodium lignosulfonate, Reed-Lignin Company.
[8]Sodium xylene sulfonate, Pfaltz and Bauer.
[9]Stepatan A, a condensation product of unsubstituted naphthalene sulfonate and formaldehyde, Stepan Chemical Company.

TABLE IV

| Temperature Time Period | Comparison of Stabilities[1] Examples, % Separation | | | |
|---|---|---|---|---|
| | D | E | F | G |
| 38° C., 2 days | 3% | | | |
| 49° C., 7 days | 9% | 47% | 47% | 43% |
| 49° C., 14 days | 15.0% | 53% | 56% | 53% |

[1]Physical stability measured as % separation,

Table IV shows the dramatic and unexpectedly superior performance in phase stability of formulations containing alkylated fused ring arylene sulfonates.

Tables V–VI below show further the surprising stabilities achieved by using the alkylated fused ring arylene sulfonate phase stabilizer and a combination phase stabilizing system comprising the alkylated fused ring arylene sulfonate combined with a $C_{6-18}$ alkyl aryl sulfonate.

TABLE V

| Formulation | Comparison of Phase Stabilizers Examples | | | |
|---|---|---|---|---|
| | H | I | J | K |
| Neodol 23-6.5[1] | 67.89 | 64.66 | 64.55 | 61.32 |
| $Na_2CO_3$[2] | 25.00 | 25.00 | 25.00 | 25.00 |
| Na Perborate × $1H_2O$[3] | 6.00 | 6.00 | 6.00 | 6.00 |
| LAS[4] | 0.00 | 0.00 | 3.34 | 3.34 |
| Inventive Fused Ring Sulfonate[5] | 0.00 | 3.23 | 0.00 | 3.23 |
| Fluorescent Whitening Agent | 0.54 | 0.54 | 0.54 | 0.54 |
| Enzyme | 0.56 | 0.56 | 0.56 | 0.56 |

[1]$C_{12-13}$ alcohol condensed with about 6.5 moles of ethylene oxide per mole, Shell Oil Company.
[2]Builder.
[3]Oxidant.
[4]Sodium salt of linear $C_{11}$ alkyl benzene sulfonate; Pilot Chemical Company (90% active).
[5]Nekal-BA 77, diisopropylnaphthalene sulfonate, GAF Chemicals.

TABLE VI

| Temperature Time Period | Comparison of Stabilities[1] Examples | | | |
|---|---|---|---|---|
| | H | I | J | K |
| 21° C., 1 wk. | 56% | 3.2% | 39% | 1.3% |
| 38° C., 1 wk. | 57% | 20% | 47% | 3.3% |
| 49° C., 1 wk. | 55% | 30% | 50% | 5.6% |

[1]Physical stability measured as % separation, layer demonstrated as a clear, liquid layer.

Tables V and VI show that the inventive compositions (I and K) have superior phase stabilities against comparative examples (H, J). As a matter of fact, the phase stability of J, containing linear alkyl benzene sulfonate (LAS) only, is quite poor, contrary to what references such as Cheng, U.S. Pat. No. 4,409,136, have contended.

Tables VII and VIII below show the performance of unalkylated fused ring arylene sulfonates versus the inventive stabilizers:

TABLE VII

| Ingredient & wt. % | Base Formulation | | | | |
|---|---|---|---|---|---|
| | | L | M | N | O |
| Neodol 23-6.5 Surfactant[1] | 61.77[2] | | | | |
| $Na_2CO_3$[3] | 24.95 | | | | |
| Sodium Perborate Monohydrate[4] | 6.11 | | | | |
| Tinopal 5BM[5] | 0.54 | | | | |
| Inventive Fused Ring Sulfonate[6] | | 3.23 | | | |
| 2-Naphthalenesulfonic acid, $Na^+$ salt[7] | | | 0.50 | | |
| 2,6 Naphthalenedisulfonic acid, $Na^+$ salt[8] | | | | 0.50 | |
| Control[9] | | | | | 0.00 |

[1]$C_{12-13}$ alcohol condensed with about 6.5 moles of ethylene oxide per mole, Shell Oil Company.
[2]Example O, control, contains 65% surfactant.
[3]Builder.
[4]Oxidant.
[5]Fluorescent whitening agent, Ciba Geigy A.G.
[6]Nekal-BA 77, diisopropylnaphthalene sulfonate.
[7]Kodak Chemical Company.
[8]Aldrich Chemical Company.
[9]No phase stabilizers. Nonionic surfactant is at 65%.

TABLE VIII

| Temperature Time Period | Comparison of Stabilities[1] Examples | | | |
|---|---|---|---|---|
| | L | M | N | O |
| 21° C., 1 wk. | 0% | 25% | 25% | 25% |
| 38° C., 1 wk. | 0% | 42% | 42% | 45% |
| 49° C., 1 wk. | 0% | 45% | 45% | 48% |

[1]Physical stability measured as % separation, layer demonstrated as a clear, liquid layer.

The above data demonstrate that the invention, Example L, has superior phase stability at elevated temperatures and extended storage times, over even unalkylated, fused ring arylenes (M,N) and a control (O).

Table IX below shows the stability of the invention against deliberate addition of water. Surprisingly, gellation did not occur at the levels added up to 20%.

TABLE IX

| Ingredient | Base Formulation | P | Q | R | S | T |
|---|---|---|---|---|---|---|
| Nonionic Surfactant | 58.34[1] | | | | | |
| Sodium Carbonate | 25.00 | | | | | |
| Sodium Perborate Monohydrate | 6.00 | | | | | |
| Calsoft F-90[3] | 3.34 | | | | | |
| Nekal BA-77[4] | 6.23 | | | | | |
| Fluorescent Whitening Agent | 0.53 | | | | | |
| Enzyme | 0.58 | | | | | |
| Water added[5] | | 1 | 3 | 5 | 9 | 15 |

TABLE IX-continued

| Ingredient | Base Formulation | P | Q | R | S | T |
|---|---|---|---|---|---|---|
| Pourable[6] | | Yes | Yes | Yes | Yes | Yes |

[1]Neodol 23-6.5, Shell Oil Company.
[2]A mixture of 9 parts developmental surfactant (nonionic) to one part Neodol 23-6.5, Shell Oil Company.
[3]Sodium salt of linear $C_{11}$ alkyl benzene sulfonate, Pilot Chemical Company (90% active).
[4]Diisopropylnaphthalene sulfonate from GAF Chemicals.
[5]Water added directly to the formulation.
[6]Pourability: Liquid is pourable within four hours after addition of water.

The invention is further exemplified in the claims which follow. However, the invention is not limited thereby, and obvious embodiments and equivalents thereof are within the claimed invention.

We claim:

1. A stable liquid, nonaqueous, detergent composition comprising, by weight percent:

(a) 20–90% of a liquid portion which comprises an alkosylated nonionic surfactant;

(b) a solids portion which comprises:

(i) 5–50% of a builder;

(ii) 0–20% of an oxidant; said solids being stably suspended in said liquid portion, by means of (c) 0.5–20% of a sulfonated, lower alkylated condensed ring aryl compound; and (d) 0–5% of a hydrolytic enzyme.

2. The liquid detergent composition of claim 1 further comprising (e) 0–50% of a detergent adjunct selected from dyes, pigments, fluorescent whitening agents, anti-redeposition agents, foam boosters, defoaming agents, organic solvents, buffers, bleach activators, enzyme stabilizers, thickeners, fragrances, and mixtures thereof.

3. The liquid detergent composition of claim 1 wherein the alkoxylated nonionic surfactant is selected from the group consisting of $C_{6-18}$ alcohols with 1–15 moles of ethylene oxide per oxide of alcohol, $C_{6-18}$ alcohols with 1–10 moles of propylene oxide per mole of alcohol, $C_{6-18}$ alcohols with 1–15 moles of ethylene oxide and 1–10 moles of propylene oxide per mole of alcohol, $C_{6-18}$ alkylphenols with 1–15 moles of ethylene oxide or propylene oxide or both, and mixtures of the foregoing.

4. The liquid detergent composition of claim 1 wherein the alkaline builder is selected from the group consisting of inorganic builders, organic builders, and mixtures thereof.

5. The liquid detergent composition of claim 4 wherein the builder is inorganic and is selected from the group consisting of the alkali metal and ammonium carbonates, silicates, phosphates, aluminosilicates and mixtures thereof.

6. The liquid detergent composition of claim 4 wherein the builder is organic and is selected from the group consisting of the alkali metal and ammonium sulfosuccinates, polyacrylates, polymaleates, copolymers of acrylic acid and maleic acid or anhydride, ethylene diamine tetraacetate, nitrilotriacetic acid, citrates, and mixtures thereof.

7. The liquid detergent composition of claim 1 wherein the oxidant is selected from the alkali metal percarbonates, perborate monohydrates, perborate tetrahydrates, hydrogen peroxide adducts, persulfates, perphosphates; and organic peroxides and peracids.

8. The liquid detergent composition of claim 1 wherein the sulfonated, alkylated condensed ring aryl is an alkylated naphthalene sulfonate.

9. The liquid detergent composition of claim 8 wherein the alkylated naphthalene sulfonate is diisopropylnaphthalene sulfonate.

10. The liquid detergent composition of claim 1 further comprising (f) an additional phase stabilizer which is a sulfated or sulfonated anionic surfactant in an amount of 0–40%.

11. The liquid detergent composition of of claim 10 in which the additional stabilizer (f) is a $C_{6-18}$ alkyl aryl sulfonate in a ratio with the stabilizer of (a) of about 1:10 to 10:1.

12. The liquid detergent composition of claim 11 wherein the additional stabilizer is a $C_{10-14}$ alkyl benzene sulfonate.

13. A phase stable, nonaqueous liquid detergent composition comprising:

(a) a liquid portion comprising at least 20% of at least one nonionic surfactant having a pour point of less than about 40° C. and an HLB of between 2 and 16;

(b) a solids portions comprising (i) at least about 5% of a builder and (ii) at least about 1% of an oxidant, the solids portion having an average particle size of between 1 to 50 microns; the solids being stably suspended in the liquid portion by a stabilizing system which comprises:

(c) a $C_{1-4}$ dialkylated naphthalene sulfonate.

14. The nonaqueous liquid detergent composition of claim 13 further comprising (d) at least 0.1% of a hydrolytic enzyme selected from proteases, amylases, lipases, cellulases, and mixtures thereof.

15. The nonaqueous liquid detergent composition of claim 13 wherein pourability is maintained despite the addition of up to 20% water.

* * * * *